US006439627B1

(12) United States Patent
Devane

(10) Patent No.: US 6,439,627 B1
(45) Date of Patent: Aug. 27, 2002

(54) PET LITTER SCOOP AND DISPOSAL DEVICE

(76) Inventor: Kenneth A. Devane, 91 Botany Hill Road, Scarborough ONT (CA), M1G 3K6

( * ) Notice: Subject to any disclaimer, the term of this patent is extended or adjusted under 35 U.S.C. 154(b) by 0 days.

(21) Appl. No.: 09/843,739

(22) Filed: Apr. 30, 2001

(51) Int. Cl.[7] ..... A01K 29/00; E01H 1/12
(52) U.S. Cl. ..... 294/1.3; 294/25
(58) Field of Search ..... 294/1.3, 1.4, 1.5, 294/25, 55; 15/257.1; 279/117.05, 117.06, 117.13

(56) References Cited

U.S. PATENT DOCUMENTS

| | | | | | |
|---|---|---|---|---|---|
| 4,205,869 | A | | 6/1980 | Mathis | |
| 4,215,886 | A | * | 8/1980 | Naderi et al. | 294/1.3 |
| D262,943 | S | | 2/1982 | Schädler | |
| 5,149,159 | A | | 9/1992 | Bardes | |
| 5,222,777 | A | * | 6/1993 | Clonch | 294/1.3 |
| 5,476,296 | A | * | 12/1995 | Gross | 294/1.3 |
| 5,564,762 | A | | 10/1996 | Ring | |
| 5,720,429 | A | * | 2/1998 | Cordle | 229/117.06 |
| 5,725,268 | A | | 3/1998 | Besasie et al. | |
| 5,836,629 | A | | 11/1998 | Hobart | |

FOREIGN PATENT DOCUMENTS

| | | | | |
|---|---|---|---|---|
| GB | 2245818 | * | 1/1992 | 294/1.3 |
| GB | 2250677 | * | 6/1992 | 294/1.3 |

* cited by examiner

*Primary Examiner*—Dean J. Kramer
(74) *Attorney, Agent, or Firm*—Bereskin & Parr

(57) ABSTRACT

A pet litter scoop and disposal device includes a container and a bag. The container has an open top end shaped to act as a scoop for scooping up pet litter. The bag has a first portion sized and shaped for lining the inner surface of the container, and a second portion sized and shaped to be folded back over the outer surface of the container for covering the hand of the user holding the container during use. The bag includes a closure for closing the upper end of the bag, comprising a pair of loops extending from the open end of the bag. The loops are preferably shaped to form a handle sized to fit over the hand of the user. The container preferably includes a holding bay at the base of the container for holding an uppermost portion of the bag so as to store the second portion of the bag against the outer surface of the container prior to deployment.

16 Claims, 9 Drawing Sheets

PET LITTER SCOOP AND DISPOSAL DEVICE

FIELD OF THE INVENTION

The present invention relates to devices for picking up and disposing of animal waste.

BACKGROUND OF THE INVENTION

People are responsible for the actions of their pets. Some pets, dogs in particular, have a habit of defecating on public property during outdoor exercise. Many municipalities now have by-laws requiring pet owners to clean up after their pets, for sanitary reasons.

One common method for cleaning up pet litter involves the use of a simple plastic bag. The pet owner reaches into the empty bag, and, with the plastic between one's hand and pet litter, picks up the litter. The bag is then turned inside out and placed in a waste receptacle. Despite the plastic layer, picking up pet litter in this fashion tends to be distasteful. As a result, some pet owners may be reluctant to clean up after their pets.

Specialized devices to assist in pet waste clean-up are known in the art, but some of these devices are too cumbersome to be carried along on a walk. Others are an awkward combination of disposable and reusable components. What is needed is a device which does not sacrifice the convenient features of a plastic bag while offering practical advantages to encourage use.

SUMMARY OF THE INVENTION

The present invention overcomes shortcomings in existing pet waste disposal devices by providing an inexpensive, ready-to-use, completely disposable device which can be conveniently transported before and after use.

The subject invention is directed towards a pet litter scoop and disposal device comprising a container and a bag. The container has an open top end, a closed bottom end, an inner surface, and an outer surface. The open top end of the container is shaped to act as a scoop for scooping up pet litter. The bag has an open upper end and a closed lower end. The bag has a first portion sized and shaped to act as a liner for lining the inner surface of the container and a second portion adapted to be folded back over the outer surface of the container so as to act as a protective covering for covering the hand of a pet owner holding the container during use. The bag comprises a closure extending from the open upper end of the bag for closing the bag after use. The closure comprises a pair of loops positioned on opposite sides of the open end of the bag, the loops being shaped to be tied together to close the bag.

The loops of the bag are preferably shaped to form a handle sized to fit over the wrist of the user. The container preferably comprises a holding bay at the base of the container sized for holding the open upper end of the bag so that the second portion of the bag is stored against the outer surface of the container. The container is preferably made of a flexible material so that it can be flattened for easy transport, and the bag is preferably made from a plastic material.

The present invention is also directed towards a pet litter scoop and disposal device comprising a container having pre-creased side and bottom panels which facilitate flattening the device for storage and transport. The container has a shovel-shaped extension at its upper end for scooping, and an opening in the bottom for storage of an uppermost portion of the bag in a manner which facilitates deployment of the device for use.

BRIEF DESCRIPTION OF THE DRAWINGS

For a better understanding of the present invention and to show more clearly how it may be carried into effect, reference will now be made, by way of example, to the accompanying drawings which show a preferred and alternative embodiments of the present invention, and in which.

DETAILED DESCRIPTION OF THE INVENTION

Figure 1:
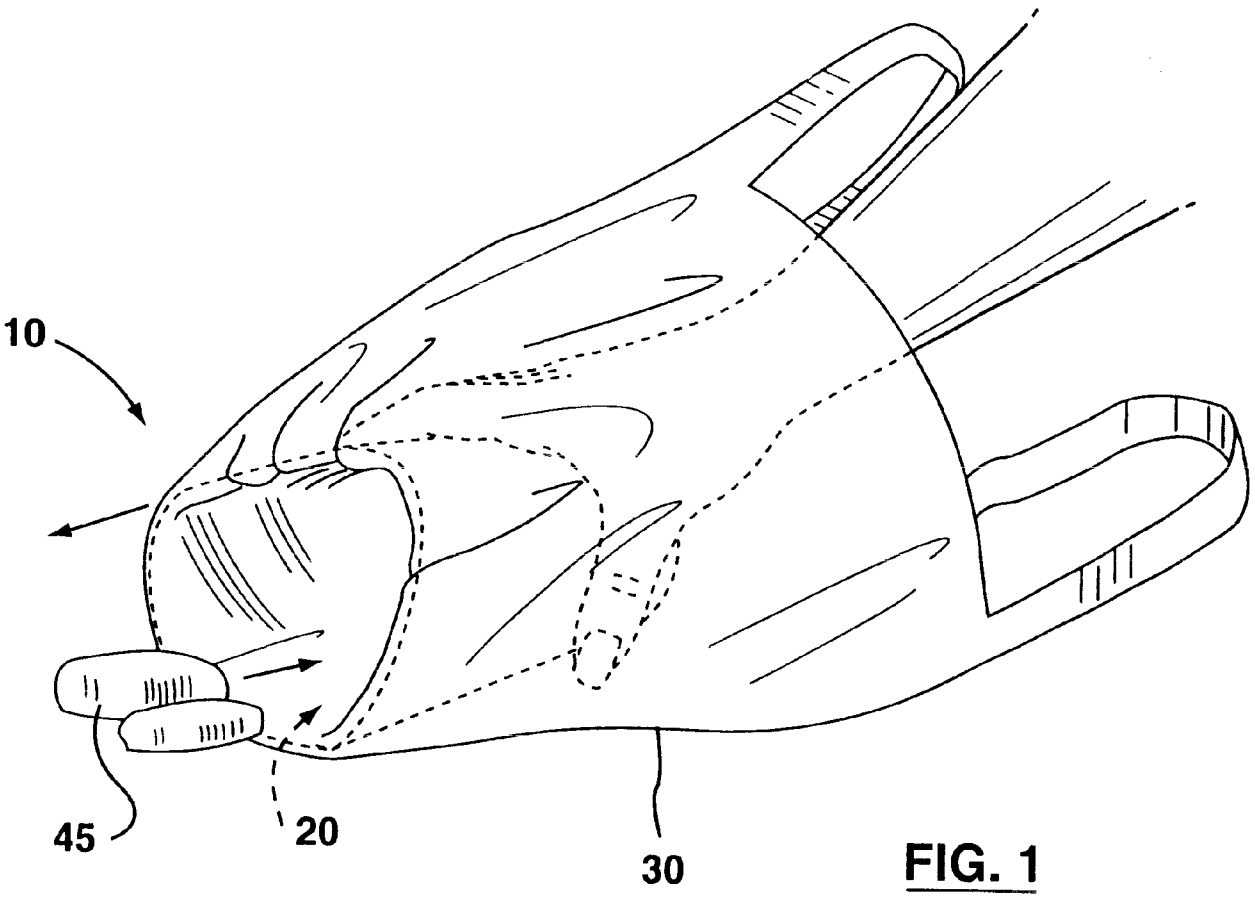
FIG. 1 is a perspective view of a pet litter scoop and disposal device made in accordance with a first embodiment of the present invention, shown being deployed to scoop up pet litter.

Referring now to FIGS. 1–5, illustrated therein is a device 10 for scooping up and disposing of pet litter, made in accordance with a first embodiment of the invention. Device 10 comprises a container 20 and a bag 30. Container 20 has an open top end 22, a closed bottom 23, and sidewall 25 having an inner surface 26, and an outer surface 28.

Figure 2:
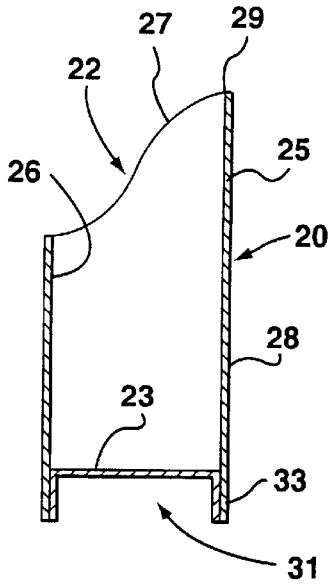
FIG. 2 is a cross-sectional view of the container of the first embodiment of the subject invention.

Sidewall 25 is shaped so that container 20 can be used to scoop up pet litter 45. Sidewall 25 preferably has a non-uniform scoop-shaped profile 27 as shown in FIG. 2, and a thin leading edge 29 which facilitates the scooping up of pet litter 45.

Container 20 also preferably includes holding bay 31 located underneath container bottom 23 for holding a portion of bag 30. Holding bay 31 is preferably a recess formed by lower sidewall portion 33.

Container 20 may be made of any suitable material such as paperboard, cardboard, styrofoam or plastic. Container 20 is preferably made of paperboard and has an inverted frusto-conical shape, similar to a disposable cup commonly used to serve coffee and the like.

Bag 30 has an open top end 32, a closed bottom end 34, an inner surface 36, and an outer surface 38. Bag 30 has a lower bag portion 35 sized and shaped to line the inner surface 26 of the container 20, and an upper bag portion 37 sized and shaped to extend over the outside surface 28 of container 20. Bag 30 comprises a closure in the form of a pair of loops 40 extending from opposite sides of open top end 32 of bag 30. Loops 40 are preferably sized and shaped to act as a handle which fits over the wrist of a user. Bag 30 can be made of any thin, flexible material, but is preferably a plastic material similar to that of bags provided in grocery stores for carrying purchased items or bags used to line garbage receptacles.

Bag 30 is coupled to container 20 by attaching the outer surface 38 of lower bag portion 35 to the inner surface 26 of container 20. This attachment may be effected by any suitable adhesive means such as glue, tape, or by directly bonding the outer surface 38 of bag 30 to the inner surface 26 of container 20 using heat, for example. Preferably, strips of double sided tape 42 are used to attach the lower portion 35 of bag 30 to the inner surface 26 of container 20.

Figure 3:
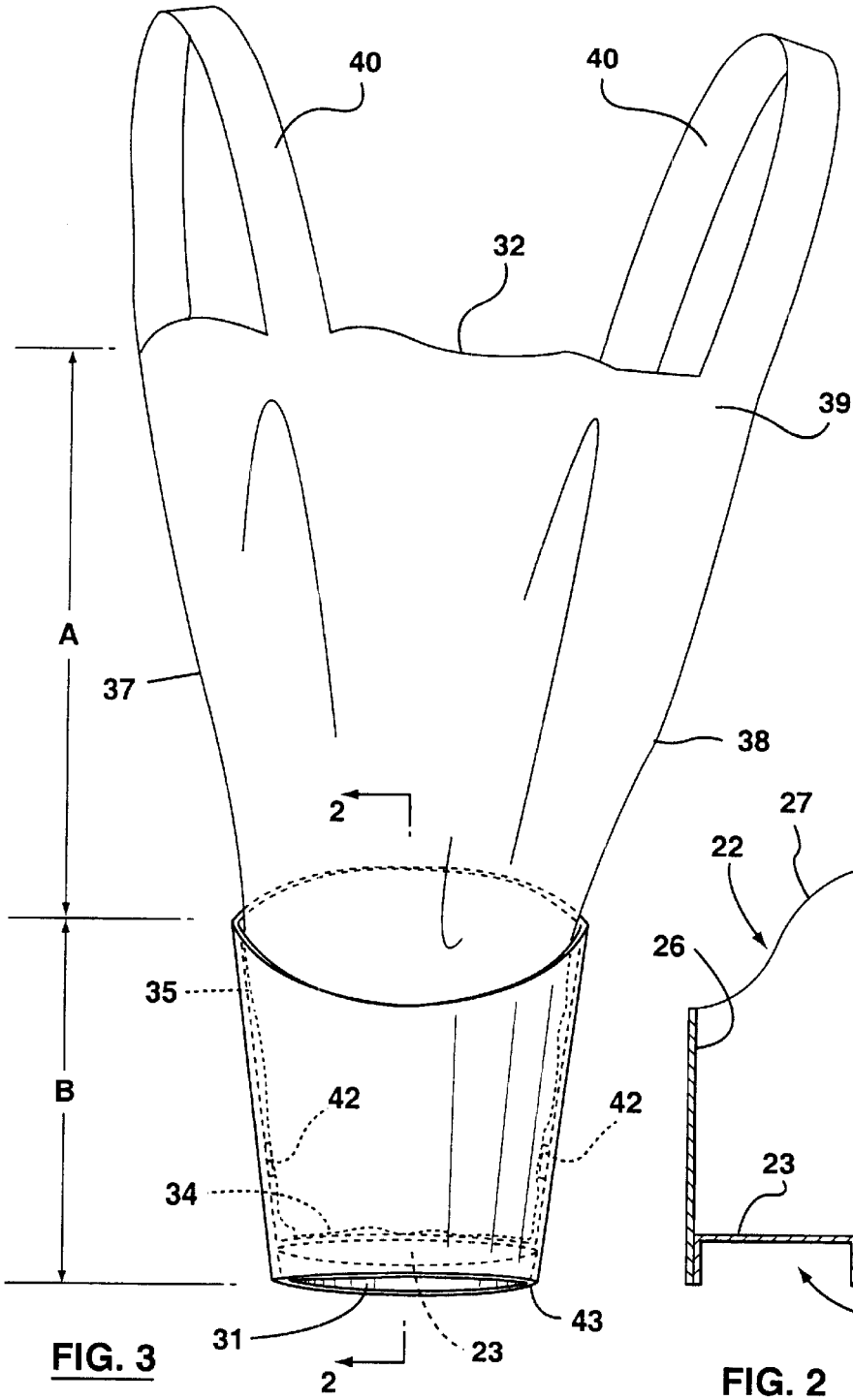
FIG. 3 is a perspective view of the subject device showing the bag in its fully extended state.

As best shown in FIG. 3, the length of bag 30 is selected so that when lower bag portion 35 is attached to container 20 as described above, upper bag portion 37 preferably extends from container 20 a distance A greater than the length B of container 20. This allows upper bag portion 37 to be folded back completely over container 20 so as to cover one's hand in use and thereby reduce the risk of contact between the user's hand and pet litter 45.

Figure 4:
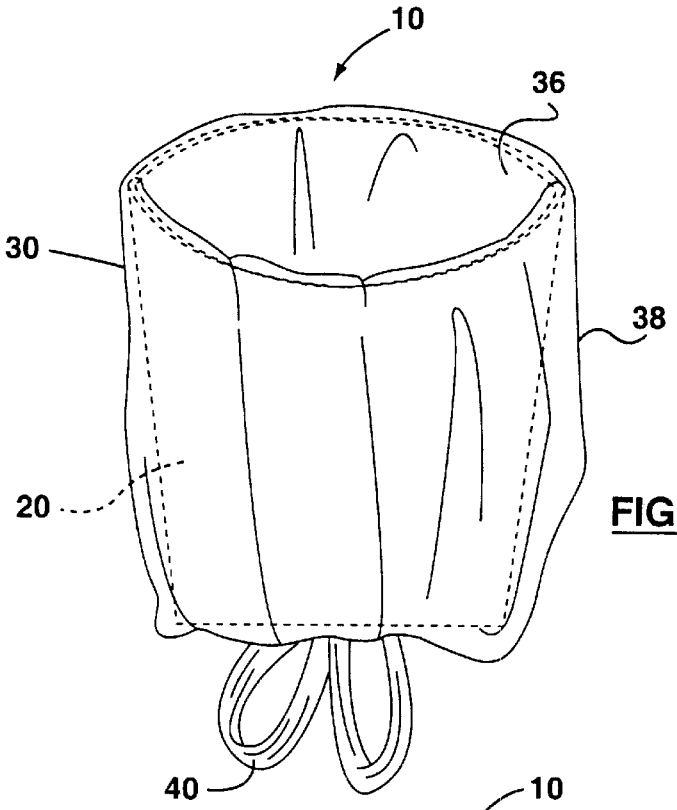
FIG. 4 is a side elevational view of the device in its flattened, pre-use state.
Figure 5:
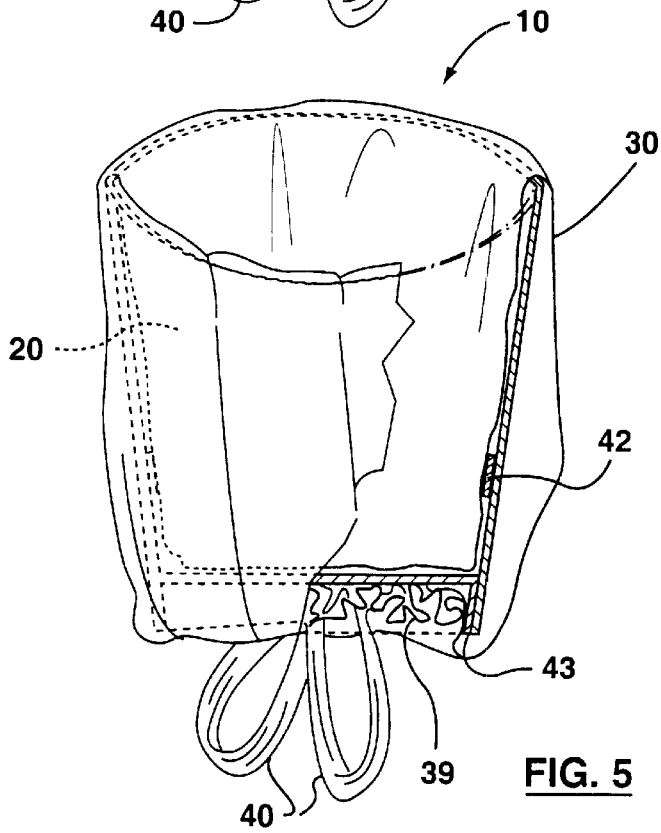
FIG. 5 is a partially cut-away side elevational view of the subject device.

Referring to FIGS. 4 and 5, bag 30 is of such a length that when upper bag portion 37 is folded back against container 20, an uppermost portion 39 of bag 30 extends beyond the bottom edge 43 of container 20. This uppermost portion 39, and loops 40, are then tucked into holding bay 31, preferably with the tips of loops 40 extending from the bottom edge 43 of container 20.

In use, scoop and disposal device 10 is deployed by removing uppermost portion 39 of bag 30 tucked in storage bay 31, preferably by pulling on the exposed portion of loops 40. The user then reaches with his or her hand underneath the folded back portion of bag 30 and opens container 20 by inwardly squeezing the sides of the flattened container 20. Pet litter can then be scooped into container 20 as lined by bag 30. Once the waste material has been scooped, container 20 is held upright and bag 30 is unfolded to extend from container 20 as shown in FIG. 3. Loops 40 can then be tied together, thereby closing the bag.

Figure 6:
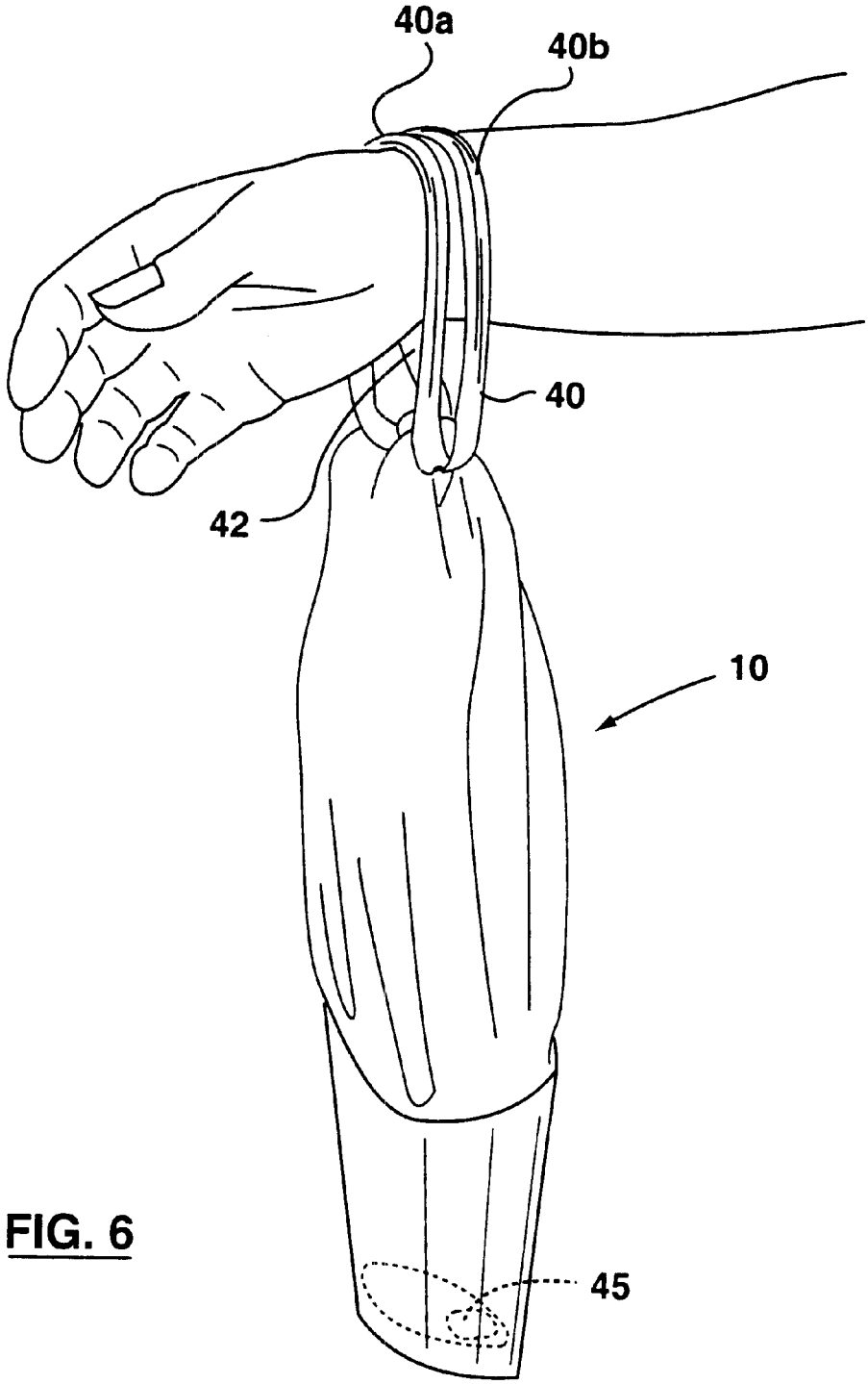
FIG. 6 shows the subject device being transported after use.

As shown in FIG. 6, after device 10 is deployed to pick up pet litter and bag 30 is closed by tying together loops 40, the user may then align the loops by registering loop 40*a* with loop 40*b*, resulting in a handle having an opening 42 sized to allow a user to insert his hand therethrough. The user may then pass his hand through opening 42 formed by aligned loops 40*a*, 40*b*, and conveniently carry device 10 and its contents 45 until disposal in a suitable waste receptacle.

Figure 7:
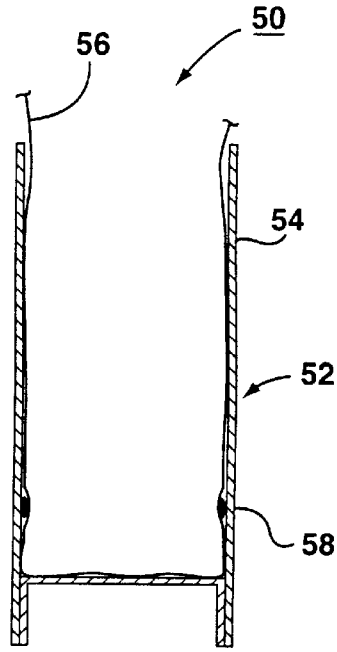
FIG. 7 is a cross-sectional view of a portion of a second embodiment of the subject invention.

Referring now to FIG. 7, illustrated therein is a portion of a device 50 made in accordance with a second embodiment of the subject invention. Device 50 comprises container 52 and plastic bag 56. Container 52 is similar to container 20 of the first embodiment, except that it does not include scoop portion 27. Rather, container 52 has a sidewall 54 of uniform height which creates a circular opening. Bag 56 is similar to bag 30 of the first embodiment, and is affixed to the sides of container 52 by glue 58.

Figure 8:
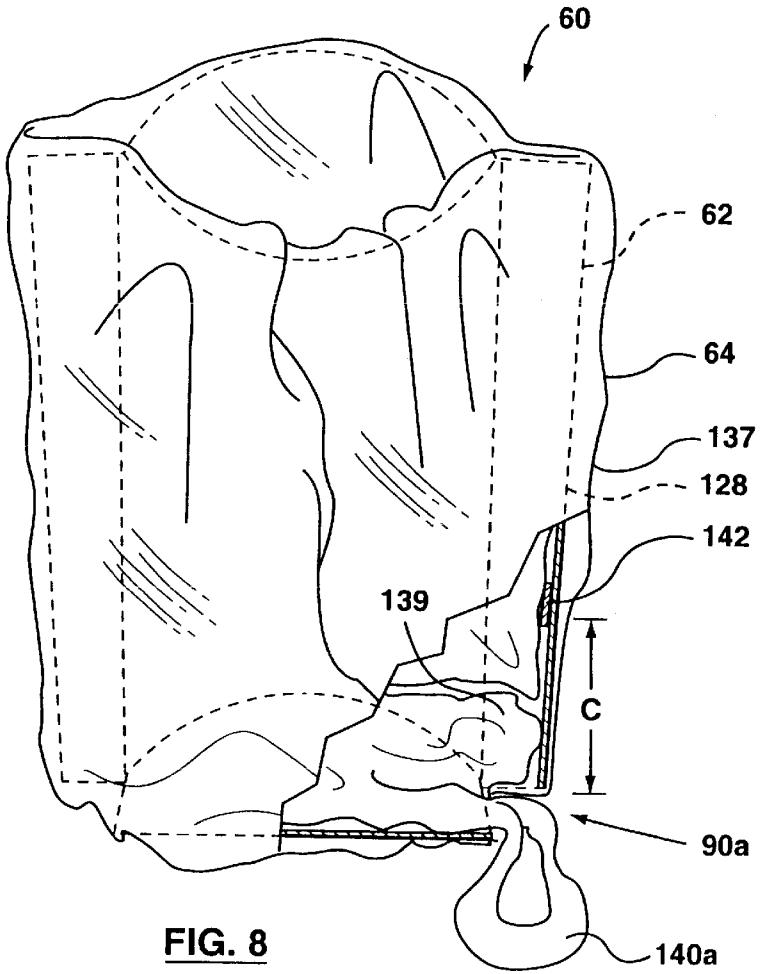
FIG. 8 is a partially cut-away front view of a third embodiment of the present invention, showing the device in its collapsed, pre-use state.
Figure 9:
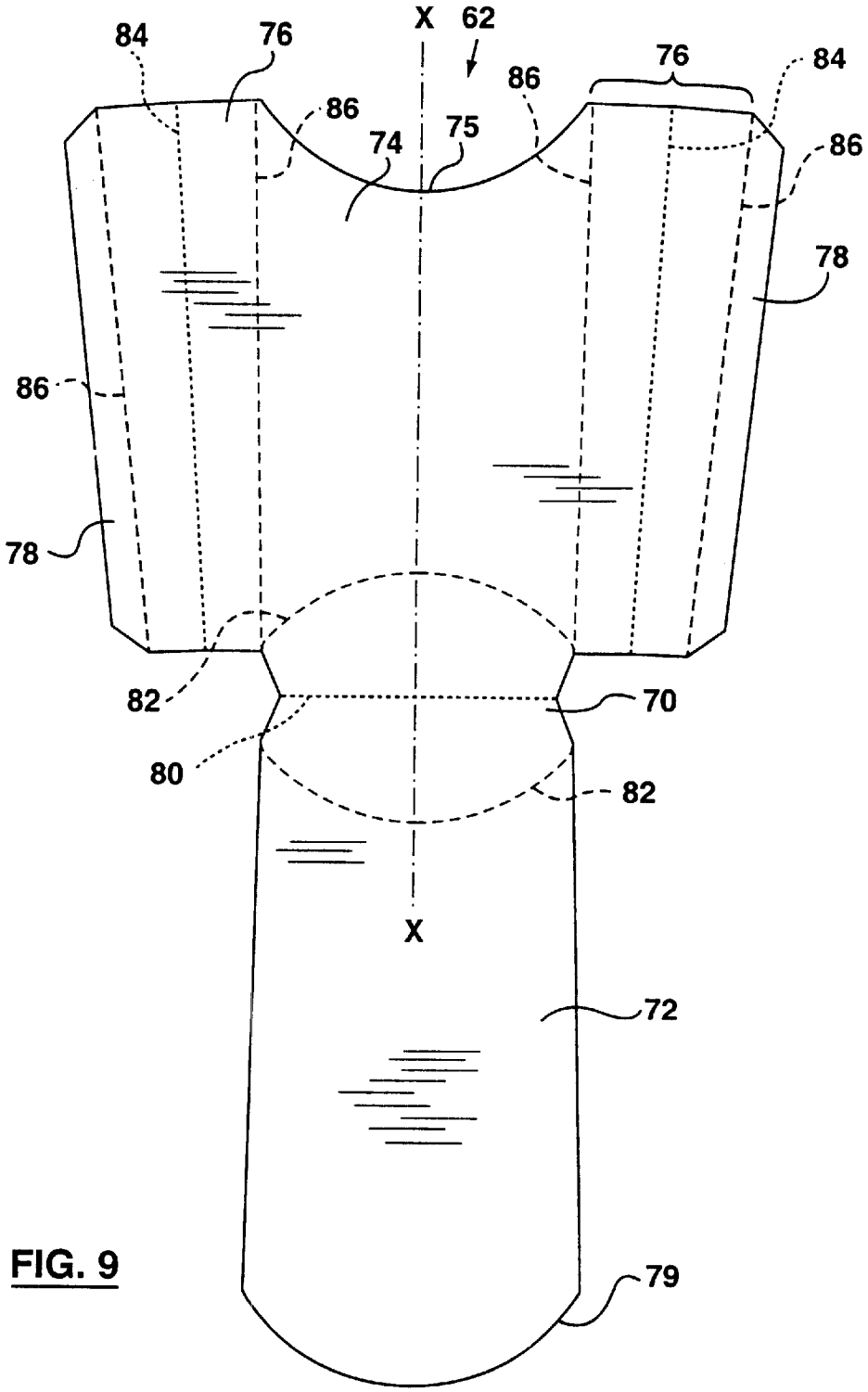
FIG. 9 is a top view of the pattern used to construct the container of the third embodiment of the present invention.

Referring now to FIG. 8, shown there is a device 60 made in accordance with a third, preferred, embodiment of the present invention. Device 60 comprises a container 62 shown in dotted outline, and a bag 64. Bag 64 acts as a lining for container 62, and is preferably identical to bag 30 of the first embodiment. While container 62 is generally similar to container 20 of the first embodiment, container 62 is preferably made from a single sheet of paperboard, the pattern for which is seen in FIG. 9. Container 62 comprises a bottom panel 70, a rear panel 72 and a front panel 74 extending from opposing sides of bottom panel 70, side panels 76 extending from opposing sides of front panel 74, and adhesion tabs 78 extending from the sides of side panels 76 opposite front panel 74.

As further illustrated in FIG. 9, bottom panel 70 is delimited from rear panel 72 and front panel 74 by bottom creases 82. Bottom panel 70 further comprises a bottom fold line 80 which extends transversely along the width of bottom panel 70, approximately equidistant from bottom creases 82. Similarly, side panels 76 are delimited from front panel 74 and adhesion tabs 78 by side creases 86. Each of the side panels 76 is provided with a side fold line 84 which extends longitudinally, approximately parallel to and equidistant from longitudinal axis x—x. Preferably, fold lines 80 and 84 are lines of perforations, while side creases 82 and 86 are longitudinal depressions pressed into the material of container 62.

Figure 10:
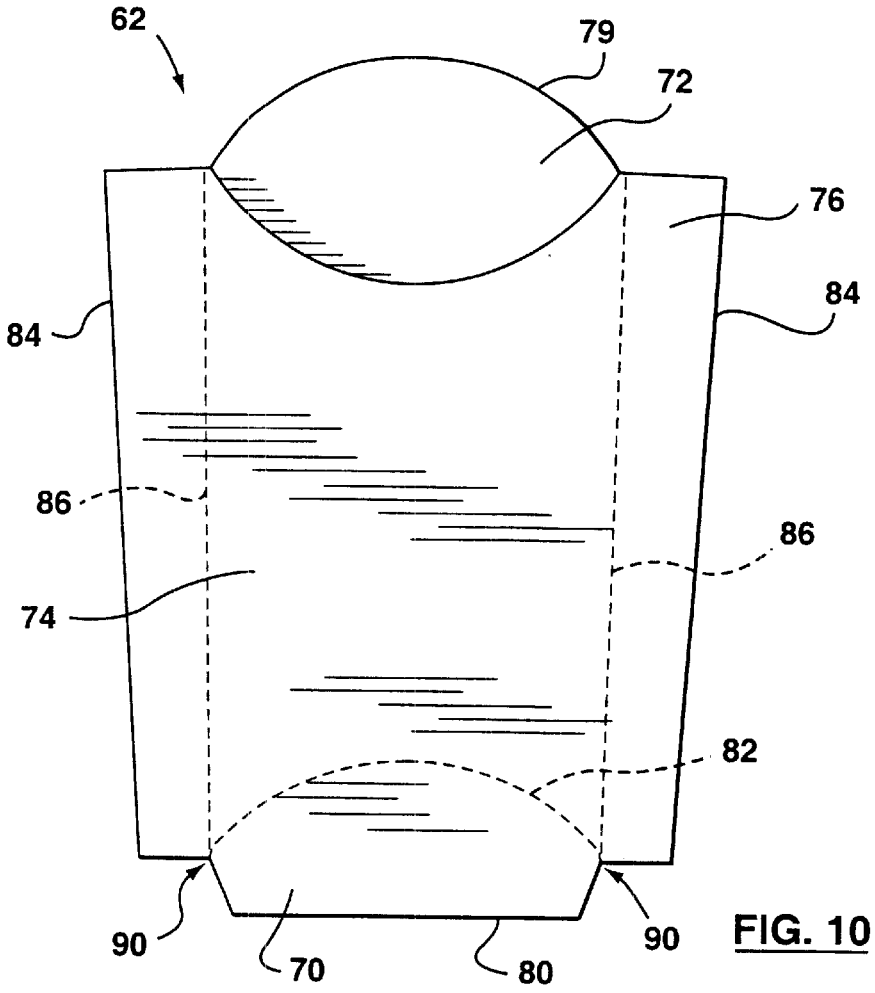
FIG. 10 is a front elevational view of the container of the third embodiment of the present invention, shown in its collapsed state.

Construction of container 62 is completed by folding the bottom panel along bottom fold line 82 so that rear panel 72 is flat against front panel 74. Side panels 76 are then folded along side fold lines 84 so that adhesion tabs 78 lie against rear panel 72. By applying any known adhesive such as tape, glue, or the like, tabs 78 are adhered to rear panel 72. When viewed facing the front panel, folded container 62 appears as illustrated in FIG. 10.

It will be appreciated that certain geometrical relationships exist within the flat pattern of container 62 seen in FIG. 9. For instance, the distance between the two side creases 86 on side panels 76 and the two bottom creases 82 on bottom panel 70 should be similar, as they cooperate to form the cross-sectional depth of container 62. As well, the length of rear panel 72 extending from bottom panel 70 should match that of side panels 76, since they cooperate to form the wall height of container 62. These dimensions can of course be varied to form differently sized containers. In so doing, container sizes can be tailored to different dog breeds.

Figure 11:
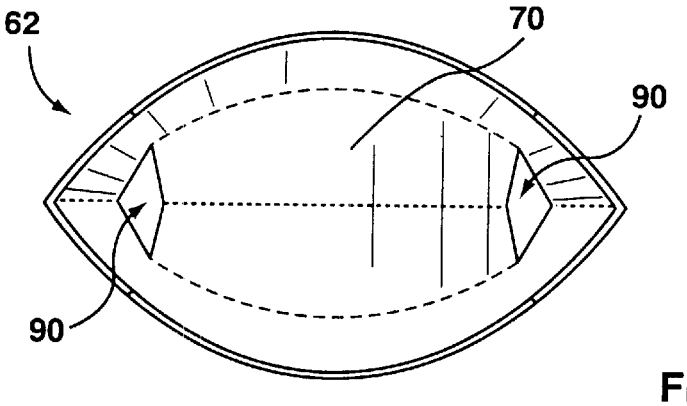
FIG. 11 is a top view of the container of a third embodiment of the present invention, shown in its expanded state.

Container 62 can be expanded from its flattened state by squeezing fold lines 84 towards each other, and inwardly pressing bottom fold line 80. Relief notches 90, as seen in FIG. 10, permit bottom panel 70 to move inward, between side panels 76. Relief notches 90 appear as openings in the bottom of expanded container 62, as seen in FIG. 11. The curved profile of bottom creases 82 provides a snap action when bottom panel 70 is pressed inward, locking bottom panel 70 in place. The profile of bottom panel 70 when container 62 is expanded can be seen in FIG. 12.

Figure 13:
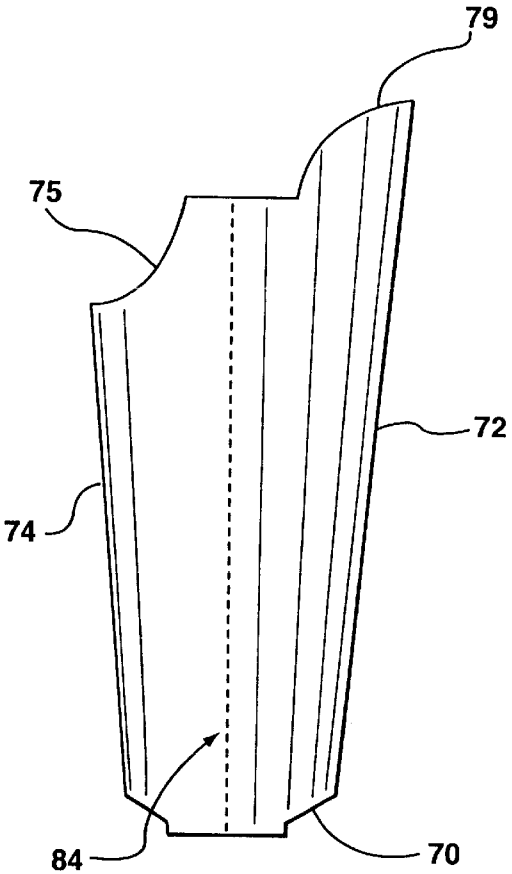
FIG. 13 is a side elevational view of the container of the third embodiment of the present invention.
Figure 12:
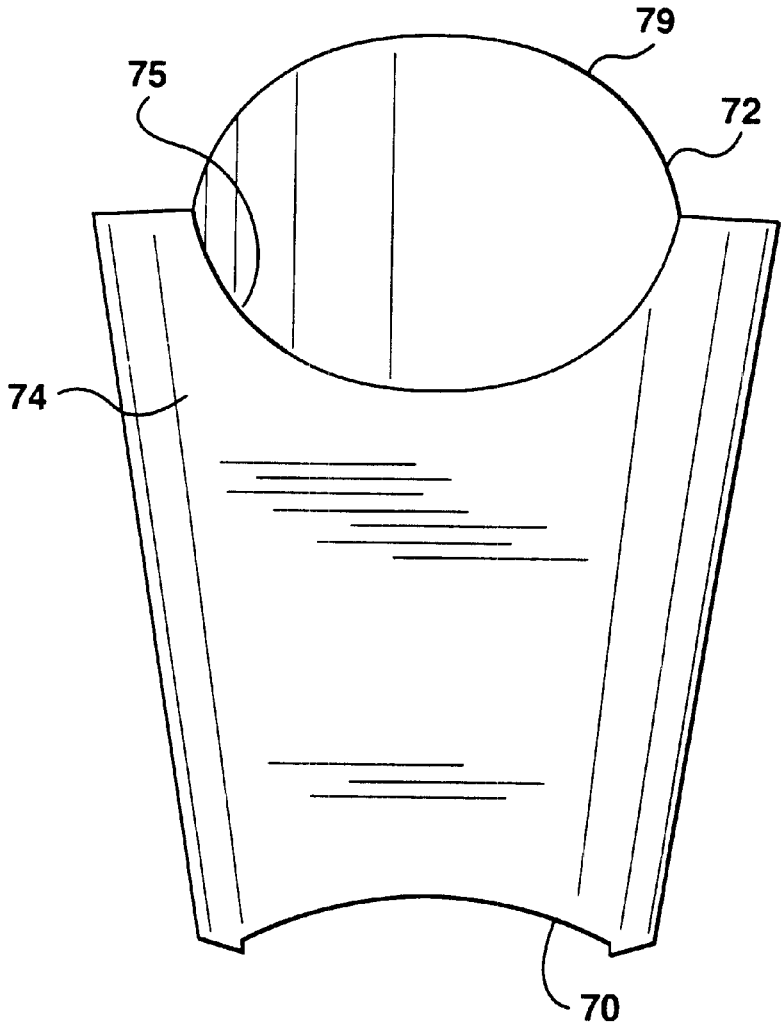
FIG. 12 is a front elevational view of the container of the third embodiment of the present invention, shown in its expanded state.

As shown in FIG. 12, container 62 further comprises a shovel-shaped scoop portion 79 extending from rear panel 72. Scoop portion 79 failitates scooping pet litter 45 into container 62 without requiring a push stick to hold pet litter 45 in place during scooping. Futhermore, it is seen that front panel 74 terminates with a concave cut-out 75 at its upper, open end, thereby improving visibility when scooping pet litter 45. A side view of container 62 showing cut-out 75 and scoop 79 is illustrated in FIG. 13.

Figure 14:
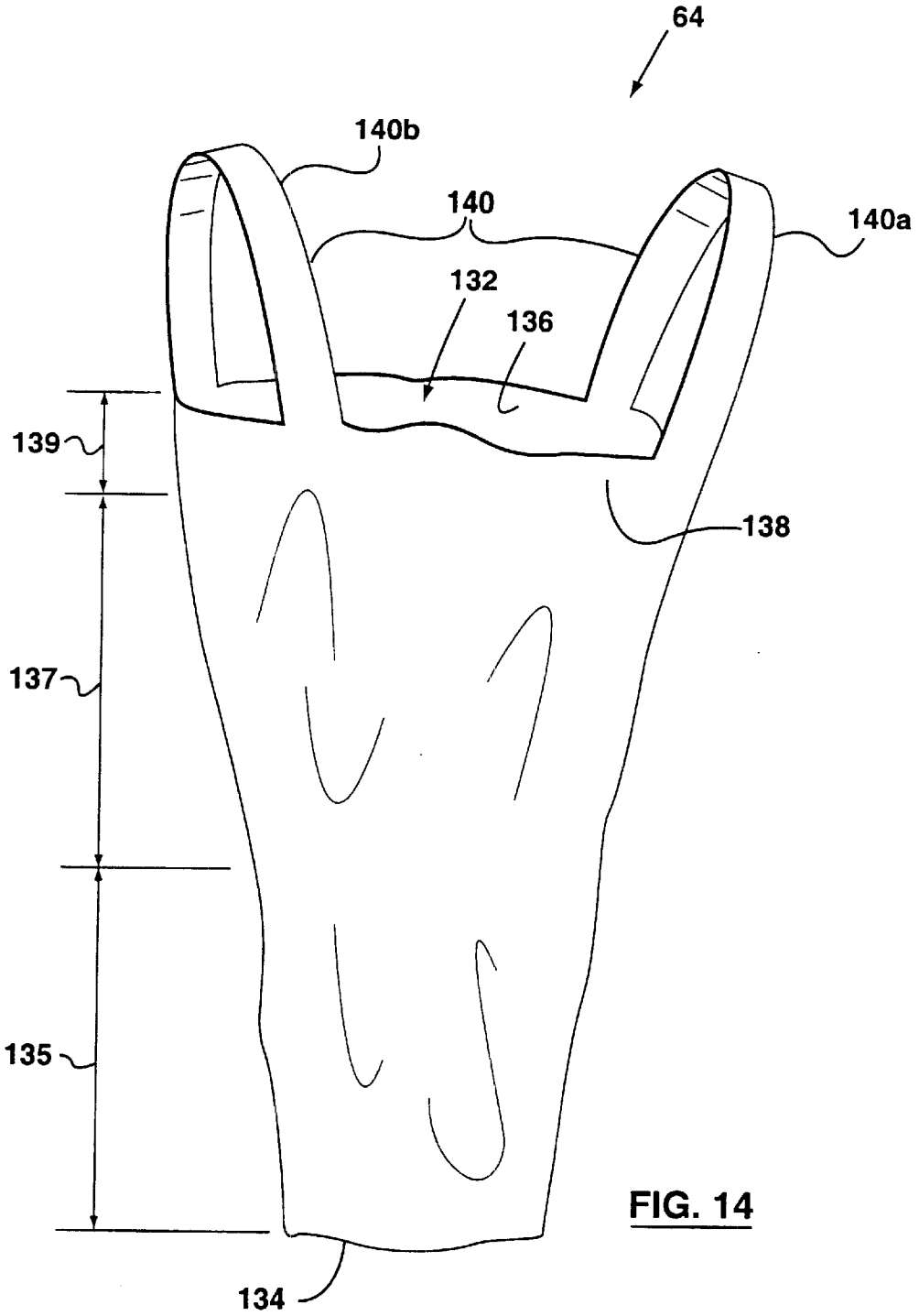
FIG. 14 is a front view of the bag of the third embodiment of the present invention, shown in its fully extended state.

Referring to FIG. 14, bag 64 has an open top end 132, a closed bottom end 134, an inner surface 136, and an outer surface 138. Bag 64 has a lower bag portion 135 sized and shaped to line the inner surface of container 62, and an upper bag portion 137 sized and shaped to extend over the outer surface of container 62. Bag 64 comprises a closure in the form of a pair of loops 140 extending from opposite sides of open top end 132 of bag 64. Loops 140 are preferrably sized and shaped to act as a handle which fits over the wrist of a user. Bag 64 further comprises an uppermost portion 139 which extends beyond the bottom edge of container 62 when folded back against the outer surface of container 62.

Referring again to FIG. 8, bag 64 is preferably attached to the inside surface of container 62 in the location shown, using two-sided tape 142 or adhesive. The upper portion 137 of bag 64 is then stored against the outside surface 128 of container 62 as shown, by gathering together uppermost portion 139 and loops 140 of bag 64 and tucking them into one relief notch 90*a* in a manner hereinafter described. Bag 64 is attached to container 62 a distance C from the bottom edge 141, to allow for the insertion of uppermost portion 139 of bag 64 through relief notch 90*a*.

Refferring to FIGS. 8 and 14, uppermost portion 139 of bag 64 is preferably tucked into notch 90*a,* in the following fashion. A first loop 140*a* of the two loops 140 is grasped at its base and twisted slightly to gather it together. The base of loop 140*a* is then inserted into relief notch 90*a,* so that a remaining upper portion of loop 140*a* remains outside container 62. The second loop 140*b* of loops 140 is then gathered together and wrapped around the base of the exposed portion of the first loop, and is then, along with the remaining material of uppermost portion 139 of bag 64, tucked into relief notch 90*a*. Care must be taken to ensure that the upper portion of loop 140*a* still emerges from relief notch 90*a,* as shown in FIG. 8.

In use, scoop and disposal device 60 is deployed by removing uppermost portion 139 of bag 64 tucked in container 62 through relief notch 90*a,* preferably by pulling on the exposed portion of loop 140*a*. The user then reaches with his or her hand underneath the folded back portion of bag 64 and opens container 62 by inwardly squeezing the sides of the flattened container 62, and pressing bottom panel 70 upwards. Pet litter 45 can then be scooped into container 62 as lined by bag 64. Once the waste material has been scooped, container 62 is held upright and bag 64 is unfolded to extend from container 62 similar to the configuration shown in FIG. 3. Loops 140 can then be tied together, thereby closing the bag.

The scoop and disposal device of the present invention has a number of advantages over the prior art. The device may be flattened to facilitate storage and transportation of the device prior to use. Storing the bag along the outside of the container by tucking an uppermost portion of the bag into a storage bay allows for quicker deployment of the device, involving relatively few steps. The upper portion of the bag can be quickly removed from the storage bay by pulling down on loops extending from the bag. During use, the thin leading edge of the scoop portion of the container facilitates the scooping action of pet litter, even on difficult surfaces such as grass, thus. avoiding the need to push pet litter into the device. After use, the loops of the bag provide a means for conveniently closing the bag and carrying the device to a suitable waste receptacle.

It should be understood that various modifications can be made to the embodiments described and illustrated herein, without departing from the subject invention, the scope of which is defined in the appended claims.

I claim:

1. A pet litter scoop and disposal device comprising:

(a) a container having an open top end, a closed bottom end, an inner surface, and an outer surface, the open top end of the container being shaped to act as a scoop for scooping up pet litter; and (b) a bag having an open upper end and a closer lower end, the bag having a first portion sized and shaped for lining the inner surface of the container and a second portion sized and shaped to be folded back over the outer surface of the container for covering a hand of a user holding the container during use;

(c) wherein the bag comprises a closure extending from the open upper end of the bag for closing the bag after use; and (d) wherein the container comprises a holding bay adjacent the bottom end of the container sized for holding an uppermost part of the bag so that the second portion of the bag is stored against the outer surface of the container prior to deployment.

2. The device of claim 1, wherein the closure comprises a pair of loops positioned on opposite sides of the open end of the bag, the loops being shaped to be tied together to close the bag.

3. The device of claim 1 wherein the pair of loops are shaped to form a handle having aligned loops defining an opening sized to allow a hand of the user to be inserted therethrough.

4. The device of claim 3 wherein the holding bay comprises a recess in the bottom end of the container.

5. The device of claim 1 wherein the container is of a flexible material that can be flattened for easy transport.

6. The device of claim 1 wherein the bag is of a plastic material.

7. The device of claim 1 wherein the container is of a paperboard material.

8. A pet litter scoop and disposal device comprising:

a) a container having an open top end, a closed bottom end, an inner surface, and an outer surface, the open top end of the container being shaped to act as a scoop for scooping up pet litter; and b) a bag having an open upper end and a closed lower end, the bag having a first portion sized and shaped for lining the inner surface of the container and a second portion sized and shaped to be folded back over the outer surface of the container for covering a hand of a user holding the container during use;

c) wherein the second portion of the bag includes an uppermost part which extends beyond the bottom end of the container when the second portion is folded back thereover; and d) wherein the container comprises a holding bay adjacent the bottom end of the container sized for holding the uppermost part of the bag so that the second portion of the bag is stored against the outer surface of the container prior to use.

9. The device of claim 8 wherein the holding bay comprises a recess in the bottom end of the container.

10. The device of claim 8, wherein the bag comprises a closure extending from the upper end of the bag for closing the bag after use.

11. The device of claim 10, wherein the closure comprises a pair of loops positioned on opposite sides of the open end of the bag, the loops being shaped to be tied together to close the bag.

12. A pet litter scoop and disposal device comprising:

(a) a container having a front panel, a rear panel, two side panels, a bottom panel, and inner surface, and an outer surface; and (b) a bag having an open upper end and a closed lower end, the bag having a first portion sized and shaped for lining the inner surface of the container and a second portion sized and shaped to be folded back over the outer surface of the container for covering the hand of a user holding the container during use;

(c) wherein the side panels each have a longitudinally extending fold line and the bottom panel has a transversely extending fold line, so that the container may be expanded from a collapsed, flattened state to an open state by inwardly squeezing the side panels, and inwardly pressing the bottom panel;

(d) wherein the second portion of the bag includes an uppermost part which extends beyond the bottom end of the container when the second portion is folded back thereover; and (e) wherein the bottom end of the container has at least one opening sized so as to enable the uppermost part of the bag to be tucked therein, so that the second portion of the bag is stored adjacent the outer surface of the container prior to use.

13. The device of claim 12 wherein the fold lines are lines of perforations.

14. The device of claim 12, wherein each side panel comprises a pair of longitudinal creases to delimit the the side panels from the front and rear panels, and the bottom panel comprises a pair of transverse creases to delimit the bottom panel from the front and rear panels, the creases running alongside the respective fold lines.

15. The device of claim 14, wherein the crease lines delimiting the bottom panel from the front and rear panels follow an inwardly curving arc such that the bottom panel snaps into and maintains a convex profile when the container is expanded from its collapsed, flattened state.

16. The device of claim 12, wherein the container further comprises a shovel-shaped scoop portion extending from the rear panel at the open end of the container.

* * * * *